US011686160B2

(12) United States Patent
Berry et al.

(10) Patent No.: US 11,686,160 B2
(45) Date of Patent: Jun. 27, 2023

(54) SYSTEM AND METHOD FOR WASHING AND DOPING OILFIELD TUBULARS

(71) Applicant: Schlumberger Technology Corporation, Sugar Land, TX (US)

(72) Inventors: Joe Rodney Berry, Cypress, TX (US); Thomas K. van der Zwet, Tomball, TX (US); Michael Brzezniak, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 276 days.

(21) Appl. No.: 17/012,247

(22) Filed: Sep. 4, 2020

(65) Prior Publication Data

US 2022/0074272 A1 Mar. 10, 2022

(51) Int. Cl.

| | |
|---|---|
| ***E21B 12/06*** | (2006.01) |
| ***E21B 17/00*** | (2006.01) |
| ***E21B 19/16*** | (2006.01) |
| ***B08B 9/023*** | (2006.01) |
| ***B08B 13/00*** | (2006.01) |
| ***E21B 19/14*** | (2006.01) |

(52) U.S. Cl.

CPC ..... *E21B 17/006* (2013.01); *B08B 9/023* (2013.01); *B08B 13/00* (2013.01); *E21B 19/14* (2013.01); *E21B 19/161* (2013.01); *B08B 2209/02* (2013.01)

(58) Field of Classification Search

CPC ..... B08B 9/023; B08B 9/021; E21B 17/006; E21B 12/06; B05B 13/0436; Y10S 118/11

See application file for complete search history.

(56) References Cited

U.S. PATENT DOCUMENTS

| | | | | |
|---|---|---|---|---|
| 2,760,585 | A | 8/1956 | Bergeron | |
| 3,971,442 | A | 7/1976 | Scott | |
| 4,014,062 | A * | 3/1977 | Scott | B08B 9/021 15/104.04 |
| 4,157,096 | A * | 6/1979 | Miller, Jr. | B08B 9/021 15/104.03 |
| 5,857,476 | A | 1/1999 | Bee et al. | |
| 6,589,343 | B1 * | 7/2003 | Egeland | E21B 17/006 118/313 |
| 7,132,127 | B2 | 11/2006 | Belik | |
| 7,371,289 | B2 * | 5/2008 | Reinholdt | B08B 9/021 134/36 |
| 7,967,540 | B2 | 6/2011 | Wright et al. | |
| 9,074,455 | B2 | 7/2015 | Pilgrim et al. | |
| 9,441,427 | B2 | 9/2016 | Pilgrim | |

(Continued)

FOREIGN PATENT DOCUMENTS

WO 2011113032 A2 9/2011

OTHER PUBLICATIONS

Search Report and Written Opinion of International Patent Application No. PCT/US2021/048582 dated Dec. 15, 2021, 10 pages.

*Primary Examiner* — Kipp C Wallace

(74) *Attorney, Agent, or Firm* — Kelly McKinney

(57) ABSTRACT

A washing and doping mechanism includes a bushing that is configured to engage a tubular that is in a substantially vertical orientation. The bushing is configured to rotate, thereby causing the tubular to rotate about a central longitudinal axis of the tubular. The washing and doping mechanism also includes a sprayer configured to spray a fluid onto the tubular in the substantially vertical orientation.

19 Claims, 8 Drawing Sheets

(56) References Cited

U.S. PATENT DOCUMENTS

| | | | | |
|---|---|---|---|---|
| 2004/0026080 | A1 | 2/2004 | Reinholdt et al. | |
| 2007/0246087 | A1* | 10/2007 | Crawford | B08B 9/023 134/198 |
| 2012/0217024 | A1 | 8/2012 | Childers et al. | |
| 2013/0340794 | A1 | 12/2013 | Flynn | |
| 2014/0110173 | A1* | 4/2014 | Belik | B05D 7/222 175/57 |
| 2014/0150719 | A1 | 6/2014 | Vatne | |
| 2015/0176349 | A1 | 6/2015 | Belik | |
| 2017/0234088 | A1 | 8/2017 | Orr et al. | |
| 2017/0254162 | A1 | 9/2017 | Magnuson | |
| 2018/0087331 | A1 | 3/2018 | Orr et al. | |
| 2018/0087332 | A1* | 3/2018 | Berry | E21B 19/14 |
| 2019/0134659 | A1* | 5/2019 | Schanlaub | B05D 1/28 |
| 2020/0179995 | A1 | 6/2020 | Loades | |
| 2020/0362643 | A1 | 11/2020 | Berry | |
| 2021/0071485 | A1* | 3/2021 | Mikalsen | E21B 17/042 |
| 2022/0003048 | A1* | 1/2022 | McKenzie | F16C 1/24 |

* cited by examiner

SYSTEM AND METHOD FOR WASHING AND DOPING OILFIELD TUBULARS

BACKGROUND

Drilling rigs form wellbores in the Earth by advancing a drill string with a drill bit located at its distal end. The drill string is generally made up of connectable sections of drill pipe, which are added on to the drill string as the drilling depth progresses. When in drilling mode, the rig may employ a top drive to rotate the drill string and a drawworks to lower the drill string into the progressing wellbore. Similarly, other types of oilfield tubulars, such as casing, may be run into the wellbore as strings that are sequentially extended in length by adding new segments of tubulars to the top of the previously-deployed string.

The tubulars are often stored in a fingerboard, sometimes vertically as stands of two or more joints of tubulars connected together. Pipe handling equipment moves the tubulars onto the rig, connects them together to form stands, and then stores the stands in the fingerboard. When the rig is ready to use a stored tubular stand, the tubular stand is retrieved from the fingerboard and brought to well center using the same or other pipe handling equipment.

To make up solid connections, the threads of the tubulars are generally cleaned. Once cleaned, a thread lubricant/sealing compound called "pipe dope" may be applied to the threads. Pipe dope is a thread compound applied to a drilling tubular to prevent galling while connecting the drilling tubular to the drill string (i.e., "making up" a connection). The pipe dope may also serve to enhance the internal pressure containment integrity of the connection. However, the process of pipe cleaning and doping is generally done manually, with a rig worker employed to clean debris from the tubular and paint the pipe dope onto the threads of the pipe. The nature of the pipe cleaning and doping activity can make this a hazardous working environment.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A washing and doping mechanism is disclosed. The washing and doping mechanism includes a bushing that is configured to engage a tubular that is in a substantially vertical orientation. The bushing is configured to rotate, thereby causing the tubular to rotate about a central longitudinal axis of the tubular. The washing and doping mechanism also includes a sprayer configured to spray a fluid onto the tubular in the substantially vertical orientation.

A rig is also disclosed. The rig includes a fingerboard configured to store a tubular in a substantially vertical orientation. The rig also includes a racking mechanism configured to move the tubular from the fingerboard. The rig also includes a washing and doping mechanism. The washing and doping mechanism includes a bushing that is configured to receive and at least partially support the tubular from the racking mechanism in the substantially vertical orientation. The bushing is at least partially conical such that the bushing is configured to contact an inner diameter of a lower end of the tubular while a gap is present beneath an outer diameter of the lower end of the tubular. The bushing is configured to rotate, thereby causing the tubular to rotate while the tubular is in the substantially vertical orientation. The washing and doping mechanism also includes a sprayer positioned radially outward from a central longitudinal axis through the bushing, the tubular, or both. The sprayer is configured to spray a fluid radially inward with respect to the central longitudinal axis, such that the fluid contacts threads of the tubular, a shoulder of the tubular, or both while the tubular is in the substantially vertical orientation and rotating. The fluid includes water, solvent, gas, pipe dope, or a combination thereof.

A method for operating a rig is also disclosed. The method includes positioning a tubular that is in a substantially vertical orientation onto a bushing such that the bushing contacts an inner diameter of a first shoulder of the tubular while a gap is present below an outer diameter of the first shoulder of the tubular. The method also includes rotating the bushing. Rotating the bushing causes the tubular to rotate therewith. The method also includes spraying the first shoulder of the tubular, a second shoulder of the tubular, and threads of the tubular with a fluid using a sprayer while the tubular is in the substantially vertical orientation.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
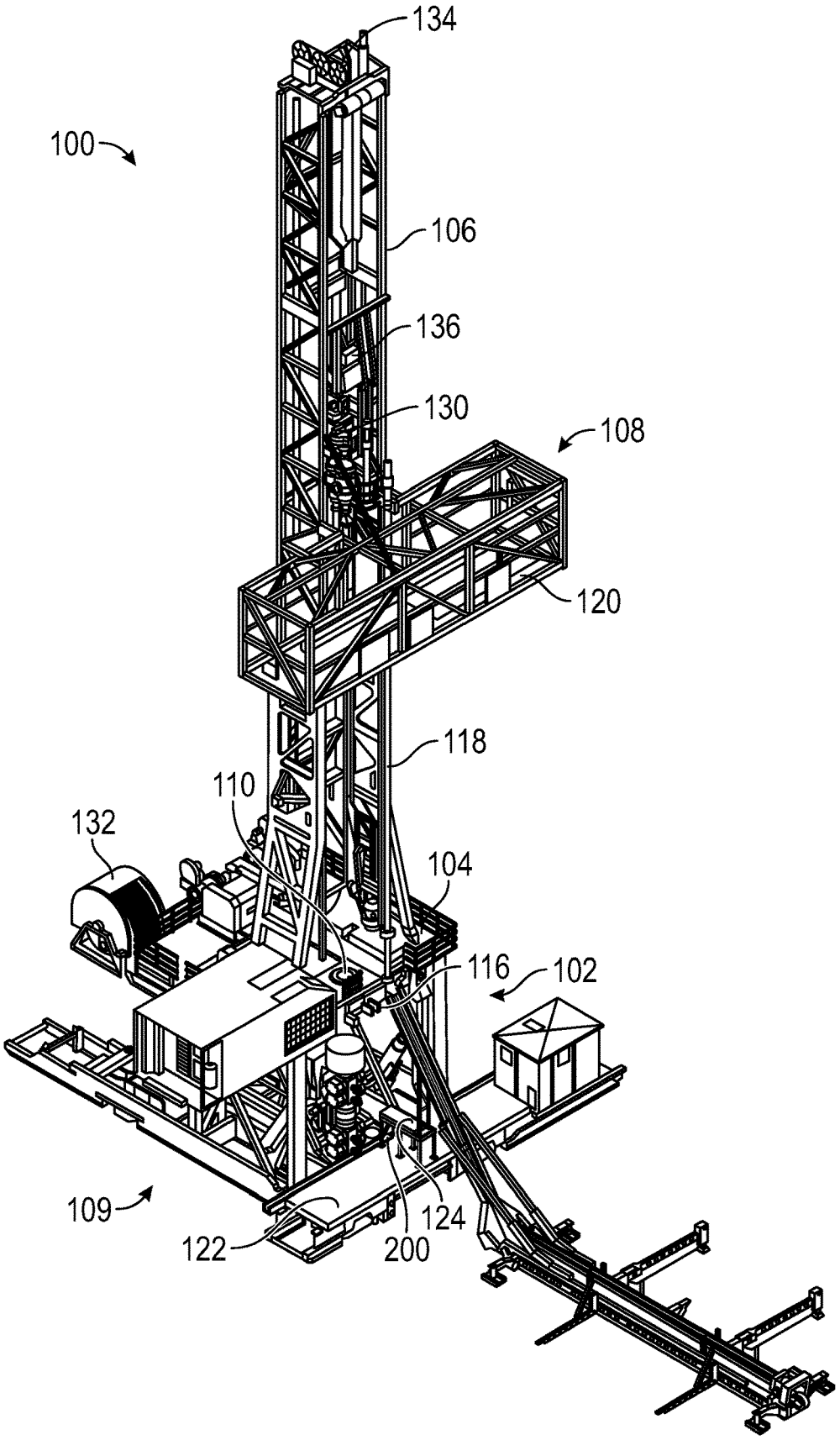
FIG. 1 illustrates a perspective view of a drilling rig system, according to an embodiment.

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Embodiments of the present disclosure may provide an automatic washing and doping apparatus and method. The apparatus and method may be used to wash and dope any type of oilfield tubulars, such as drill pipe, casing, liners, etc. The automatic washing and doping process may occur at a washing and doping position (also referred to as a stand handoff position or SHP), where stands are held after being removed from the vertical storage, but prior to being positioned at well center. Conducting washing and doping at this position, and on the lower end of the stand (also referred to as the male end or pin end of the stand), allows for substantial automation of the washing and doping process, without adding time to the drilling or tripping-in process. For example, many stands may be stored in the stand storage assembly, ready and available for use. However, the well-center activities (e.g., joining a new stand to a string, advancing the string, raising the top drive (or another tubular-running device) to receive the next stand) may take substantially longer than retrieving a stand from storage, and potentially longer even than building a stand, storing the stand, and then retrieving a stand. Accordingly, embodiments of the present disclosure may capitalize on this difference in process cycle times to add the pipe washing and doping activities to a point in the workflow that does not impede or slow any other activities in the workflow, thereby increasing rig operational efficiency.

Before detailing several embodiments of the automatic washing/doping process, it will be instructive to discuss an embodiment of the drilling rig system that implements this process. Thereafter, the process will be understood with reference to the drilling rig system, with it being appreciated that the drilling rig system disclosed is but one example among many contemplated for executing various embodiments of the processes herein.

Accordingly, FIG. 1 illustrates a perspective view of a drilling rig system 100, according to an embodiment. The drilling rig system 100 may generally include a catwalk 102, a rig floor 104, a mast 106, a stand storage assembly 108, and a substructure 109, among potentially many other components. The rig floor 104 may be supported above the ground by the substructure 109. Furthermore, on the rig floor 104, a well center 110 may be defined, which may demark a center of a wellbore beneath the drilling rig system 100. Various equipment may be located at or above the well center 110 to drill, trip in, or trip out, depending on the drilling or completion operation that is active at any given point. Further, below the rig floor 104, and above, or slightly below, the ground (i.e., in the "cellar" of the rig system 100), equipment may be positioned such as a blowout preventer, casing spool, casing head, rotary seals, etc.

The catwalk 102 may be oriented at an incline, and may be configured to deliver drill pipe, casing, or other tubulars from a horizontal configuration on the ground up to or near the rig floor 104. Pipe handling equipment may receive the tubulars from the catwalk 102. The tubular may then be joined with other tubular(s) to form a stand 118, e.g., while supported in a mousehole 116, and then the stand 118 may be stored in the stand storage assembly 108.

The stand storage assembly 108 may include a fingerboard 120, which may receive and support the top ends (also referred to as the female ends or box ends) of the stands 118. A setback platform 122 may be positioned below the fingerboard 120 and may support the lower ends (also referred to as the male ends or pin ends) of the stands. As such, the stands may be held in position, in a vertical orientation, and prepared for later use. As shown, the setback platform 122 may be positioned at an elevation that is below the rig floor 104 (e.g., on the baseboxes of the substructure 109). A lower constraint 124 may be positioned at the setback platform 122 level, and may be configured to engage the lower ends of the stands as they are removed from the fingerboard 120 and received into the washing and doping position (also referred to as the stand handoff position).

A washing and doping mechanism 200 may be coupled to or positioned at least partially on or in the setback platform 122 or the lower constraint 124. The washing and doping mechanism 200 may be substantially concentric with the stand handoff position (SHP). The washing and doping mechanism 200 may be configured to wash, dry, and/or apply pipe dope (e.g., lubricant and/or grease) to the lower ends of the stands 118, as described in greater detail below.

The mast 106 may include hoisting and drilling equipment, such as, for example a top drive 130. The top drive 130 may be movable up and down along the mast 106 (e.g., using a drawworks 132) attached via a cable to a crown block 134 at the top of the mast 106, and a travelling block 136 that is coupled to the top drive 130. The top drive 130 may be configured to stab into the top end of the stand 118 above well center 110. For example, stands 118 may be brought into connection with an upper connection of previously-run drill string sections (i.e., a "stump"). Tongs may then be provided on the rig floor 104, which may connect the stand 118 to the previously-run drill string. The top drive 130 may then rotate the stand 118 (now made up to the tubular string) to rotate the drill string.

Figure 2:
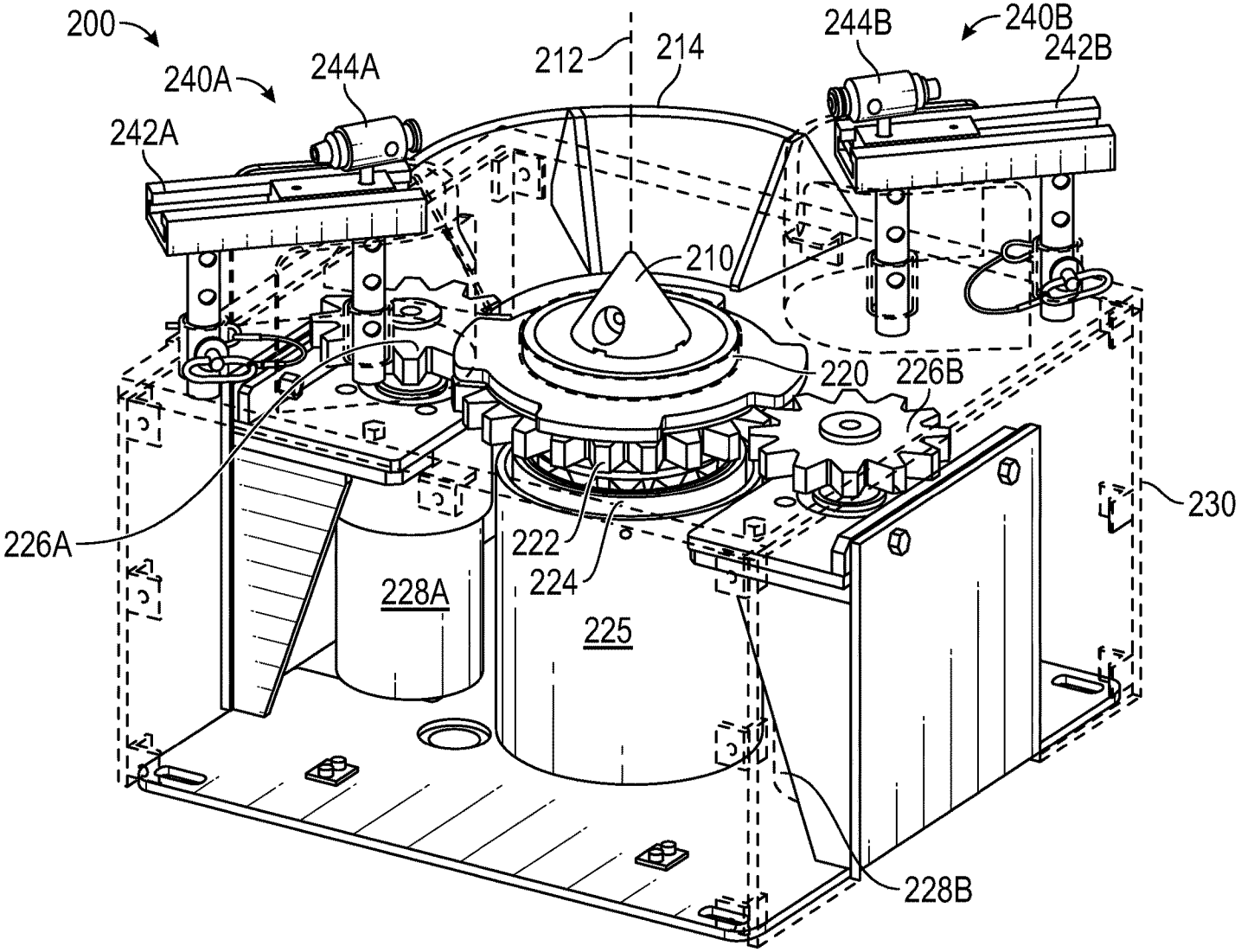
FIG. 2 illustrates a perspective view of a washing and doping mechanism in the drilling rig system, according to an embodiment.

FIG. 2 illustrates a perspective view of the washing and doping mechanism 200, according to an embodiment. The washing and doping mechanism 200 may include a bushing 210 that is configured to receive the lower end of the stand 118 (not shown in FIG. 2). More particularly, the stand 118 may be lowered with respect to the washing and doping mechanism 200 until the bushing 210 becomes positioned/inserted at least partially into the lower end of the stand 118. As shown, the bushing 210 may be at least partially conical or frustoconical to facilitate the alignment of the stand 118 and the bushing 210 as the stand 118 is lowered onto the bushing 210. Thus, a cross-sectional width (e.g., diameter)

of the bushing 210 may increase proceeding downward with respect to a central longitudinal axis 212 through the bushing 210.

The washing and doping mechanism 200 may also include a bumper (also referred to as a guard) 214 that is positioned radially outward from the bushing 210 with respect to the central longitudinal axis 212 and extends upward therefrom. The bumper 214 may be oriented/tilted at an angle such that a distance between the central longitudinal axis 212 and the bumper 214 increases proceeding upward. The bumper 214 may also facilitate the alignment of the stand 118 and the bushing 210 as the stand 118 is lowered onto the bushing 210. The bumper 214 may extend around a portion of the circumference (e.g., from about 60 degrees to about 180 degrees) around the bushing 210, and the stand 118 may be introduced into the washing and doping mechanism 200 through a different portion of the circumference around the bushing 210 so that the automatic pipe handling (APH) system does not have to lift the stand 118 over the bumper 214. In at least one embodiment, the bumper 214 may be omitted.

The washing and doping mechanism 200 may also include a drive gear bushing 220 that is coupled to and/or positioned below the bushing 210. In at least one embodiment, the bushing 210 may be omitted, and the lower end of the stand 118 may be lowered/received onto the drive gear bushing 220. The washing and doping mechanism 200 may also include a drive gear 222 that is coupled to and/or positioned below the drive gear bushing 220. The washing and doping mechanism 200 may also include a bearing 224 that is coupled to and/or positioned below the drive gear 222. The drive gear bushing 220, the drive gear 222, and/or the bearing 224 may facilitate rotation of the bushing 210, as described below.

In at least one embodiment, a load cell 225 may be coupled to and/or positioned below the bearing 224. When the stand 118 is positioned on and/or supported by the bearing 210, the load cell 225 may be configured to measure the load. For example, when the load measured by the load cell 225 is greater than a predetermined threshold, the load cell 225 (or a computing system in communication therewith) may infer that the stand 118 is positioned on and/or supported by the bearing 210 of the washing and doping mechanism 200. When the load measured by the load cell 225 is less than the predetermined threshold, the load cell 225 (or the computing system) may infer that the stand 118 is not positioned on and/or supported by the bearing 210 of the washing and doping mechanism 200.

The washing and doping mechanism 200 may also include one or more pinion gears (two are shown: 226A, 226B) that are engaged with the drive gear 222. The washing and doping mechanism 200 may also include one or more motors (two are shown: 228A, 228B) that are configured to drive the pinion gears 226A, 226B.

The washing and doping mechanism 200 may also include a housing 230. At least a portion of the housing 210 is transparent in FIG. 2 to better illustrate the internal components. As shown, the drive gear 222, the bearing 224, the load cell 225, the pinion gears 226A, 226B, the motors 228A, 228B, or a combination thereof may be positioned at least partially within the housing 230. The bushing 210, the bumper 214, and/or the drive gear bushing 220 may be positioned on and/or above the housing 230.

The washing and doping mechanism 200 may also include one or more sprayers (two are shown: 240A, 240B). The sprayers 240A, 240B may be coupled to and/or positioned above the housing 230. The sprayers 240A, 240B may be circumferentially offset from one another (e.g., by about 180 degrees) around the central longitudinal axis 212. Each sprayer 240A, 240B may include a platform 242A, 242B and a nozzle 244A, 244B. One or more of the nozzles 244A, 244B may be configured to spray water, solvent, gas (e.g., air), pipe dope (e.g., grease and/or lubricant), or a combination thereof onto the stand 118 to wash, dry, and dope the stand 118.

The platforms 242A, 242B may be configured to move vertically up and down with respect to the housing 230 to vary the axial location on the stand 118 that is sprayed. The platforms 242A, 242B and/or the nozzles 244A, 244B may also or instead be configured to move radially inward (e.g., toward the stand 118) and radially outward (e.g., away from the stand 118) with respect to the central longitudinal axis 212 to vary the surface area of the stand 118 that is sprayed and/or the velocity/force of the fluid as it contacts the stand 118. For example, the nozzles 244A, 244B may move radially within a track in an upper surface of the platforms 242A, 242B. The platforms 242A, 242B and/or the nozzles 244A, 244B may also or instead be configured to be adjusted to vary the angle at which the nozzles 244A, 244B spray. For example, the angle may be varied from about 0 degrees (e.g., horizontal) to about +/−5 degrees with respect to horizontal, +/−10 degrees with respect to horizontal, +/−30 degrees with respect to horizontal, or +/−45 degrees with respect to horizontal. As described in greater detail below, varying the angle may allow the spray to contact the threads of the lower end of the stand 118, one or more shoulders on the lower end of the stand 118, or a combination thereof. The movement of the sprayers 240A, 240B may be performed manually or automatically by a computing system based at least partially upon the size, shape, and/or connection type(s) of the stand 118.

In operation, the motors 228A, 228B may be configured to cause the pinion gears 226A, 226B to rotate. The pinion gears 226A, 226B may be engaged with the drive gear 222 and thus cause the drive gear 222 rotate. The drive gear bushing 220 and/or the bushing 210 may be configured to rotate together with the drive gear 222. When the lower end of the stand 118 is positioned on the bushing 210, the stand 118 may rotate in a vertical orientation together with the bushing 210. As the stand 118 rotates, the nozzles 244A, 244B of the sprayers 240A, 240B may be configured to spray the lower end of the stand 118 with water, solvent, gas (e.g., air), pipe dope (e.g., grease and/or lubricant), or a combination thereof. In at least one embodiment, an encoder (e.g., coupled to one or more of the gears 222, 226A, 226B) may be configured to measure a number of rotations of the bushing 210 and/or the stand 118. Once the number of rotations reaches a predetermined threshold, it may be determined that the lower end of the stand 118 has been sufficiently cleaned and/or doped, and the motors 228A, 228B may stop.

Figure 3:
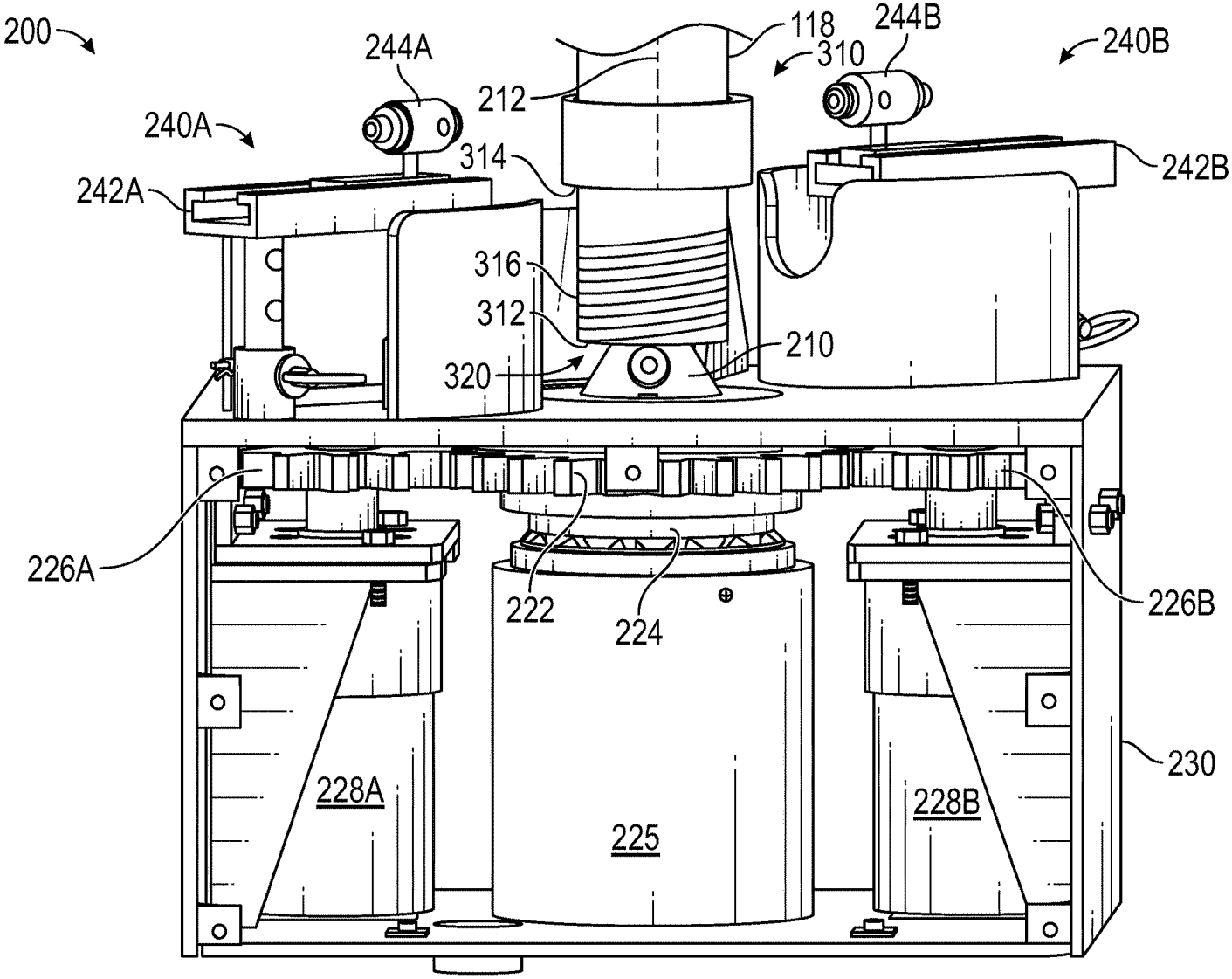
FIG. 3 illustrates a side view of the washing and doping mechanism receiving a lower end of a tubular stand, according to an embodiment.

FIG. 3 illustrates a side view of the washing and doping mechanism 200 with the lower end (also referred to as the male end or the pin end) 310 of the stand 118 positioned on the bushing 210 and extending upward therefrom, according to an embodiment. In FIG. 3, a side of the housing 230 has been removed to better illustrate the internal components (e.g., the drive gear bushing 220, the drive gear 222, the bearing 224, the load cell 225, the pinion gears 226A, 226B, and the motors 228A, 228B).

As shown, the lower end 310 of the stand 118 may include a first (e.g., nose) shoulder 312, a second (e.g., sealing) shoulder 314, and threads 316 positioned therebetween. The first shoulder 312 may be configured to contact the bushing 210. Due to the (e.g., conical) shape of the bushing 210, an inner diameter of the first shoulder 312 may be configured to contact the bushing 210; however, an outer diameter of the first shoulder 312 may be spaced vertically apart from the bushing 210 and/or the drive bear bushing 220. In other words, a gap 320 may be present between the outer diameter of the first shoulder 312 and the bushing 210 and/or the drive gear bushing 220.

The nozzles 244A, 244B of the sprayers 240A, 240B may be configured to spray the first shoulder 312, the second shoulder 314, and/or the threads 316 sequentially or simultaneously with water, solvent, gas (e.g., air), pipe dope (e.g., grease and/or lubricant), or a combination thereof. The bushing 210 and the stand 118 may rotate together as the nozzles 244A, 244B spray to clean and lubricate around the full circumference of the lower end 310 of the stand 118.

Figure 4:
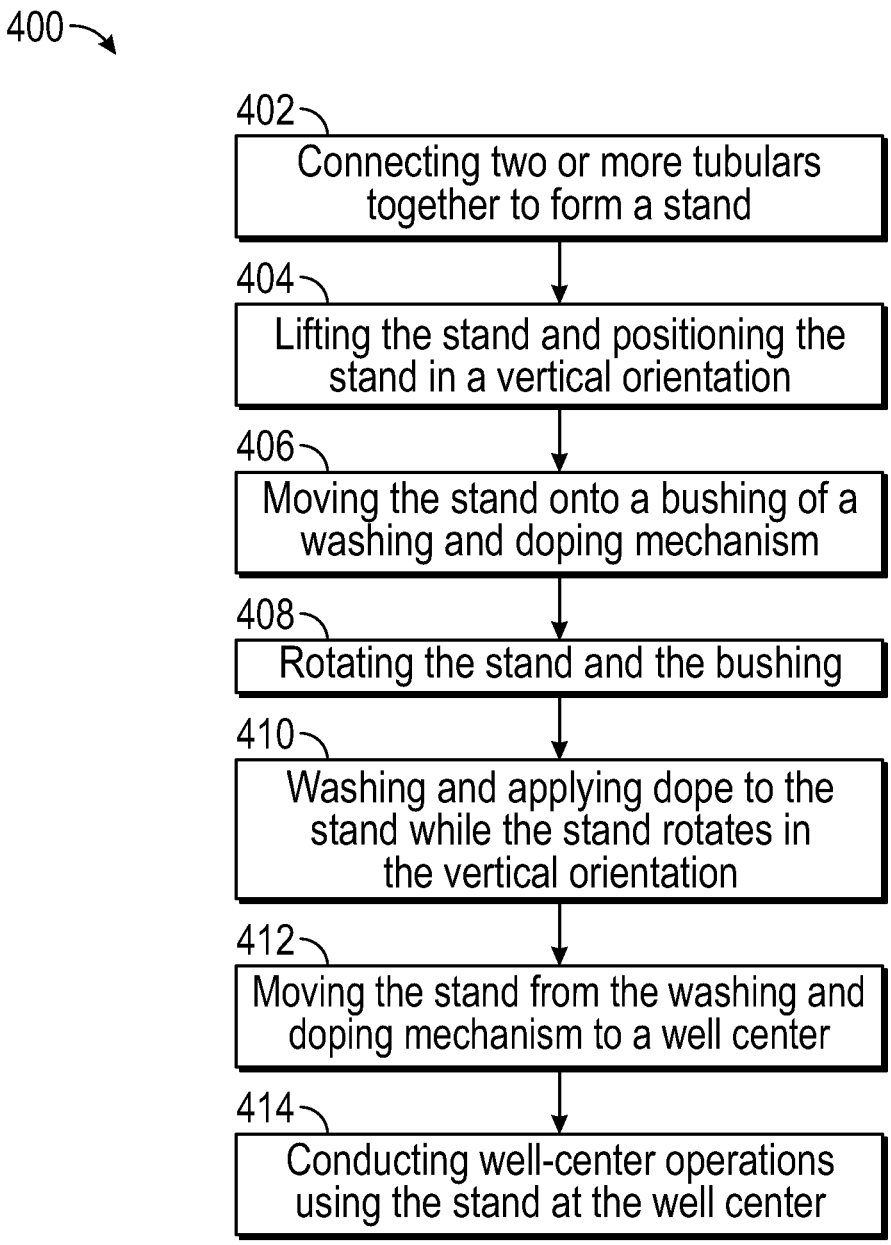
FIG. 4 illustrates a flowchart of a method for operating the drilling rig system, according to an embodiment.

FIG. 4 illustrates a flowchart of a method 400 for operating a drilling rig system, according to an embodiment. The method 400 may proceed using one or more embodiments of the drill rig system 100 discussed above, but at least some embodiments may be operable on other drilling rig systems 100. An illustrative order of the method 400 is described below; however, one or more portions of the method 400 may be performed in a different order, repeated, or omitted.

Figure 5:
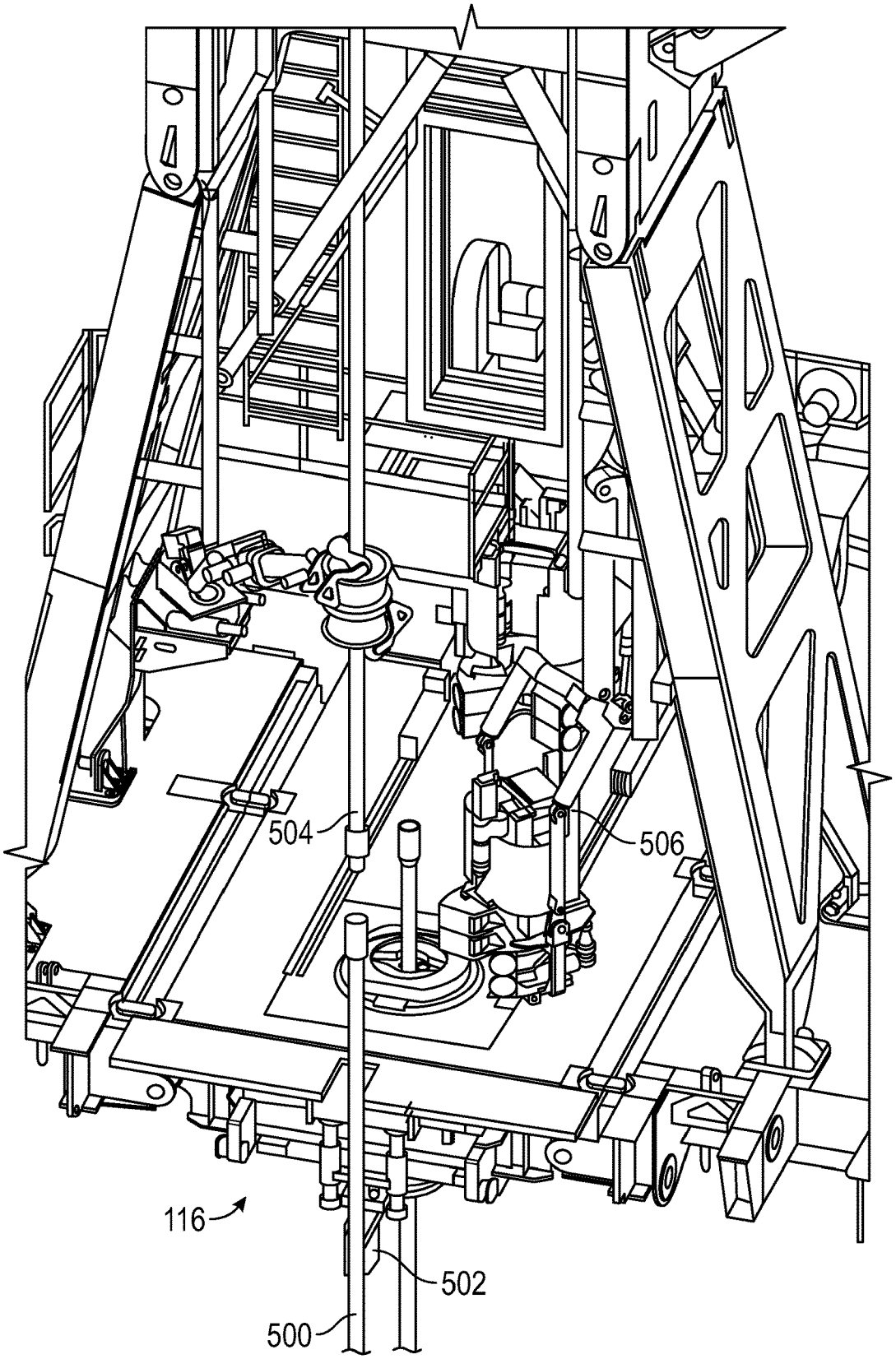
FIG. 5 illustrates a perspective view of a rig floor and a mousehole of the drilling rig system, according to an embodiment.

Accordingly, in this example, the method 400 may begin by connecting together two or three sections or "joints" of tubular to form the stands 118, as at 402 (e.g., a "first" stand, for purposes of this description). The joints may each be received by tubular handling equipment from the catwalk 102, secured in the mousehole 116, and connected together in sequence therein (e.g., using tongs). This process is illustrated in FIG. 5. As shown in FIG. 5, a tubular segment or "joint" 500 is held in the mousehole 116 via a gripping device 502. A second tubular segment 504 is then brought over the mousehole 116 and lowered toward the tubular segment 500. Tongs 506 (e.g., an iron roughneck) may then be brought into position and used to screw the first and second tubular segments 500, 504 together. The combination of the tubular segments 500, 504 may then be lowered into the mousehole 116 to allow for a third tubular segment to be connected thereto, to complete the stand 118 (see FIG. 1). Although not shown in FIG. 5, the washing and doping mechanism 200 may be positioned at the setback platform 122 level and substantially concentric with (e.g., below) the tubular segment 500 shown in the stand handoff position (SHP).

Figure 6:
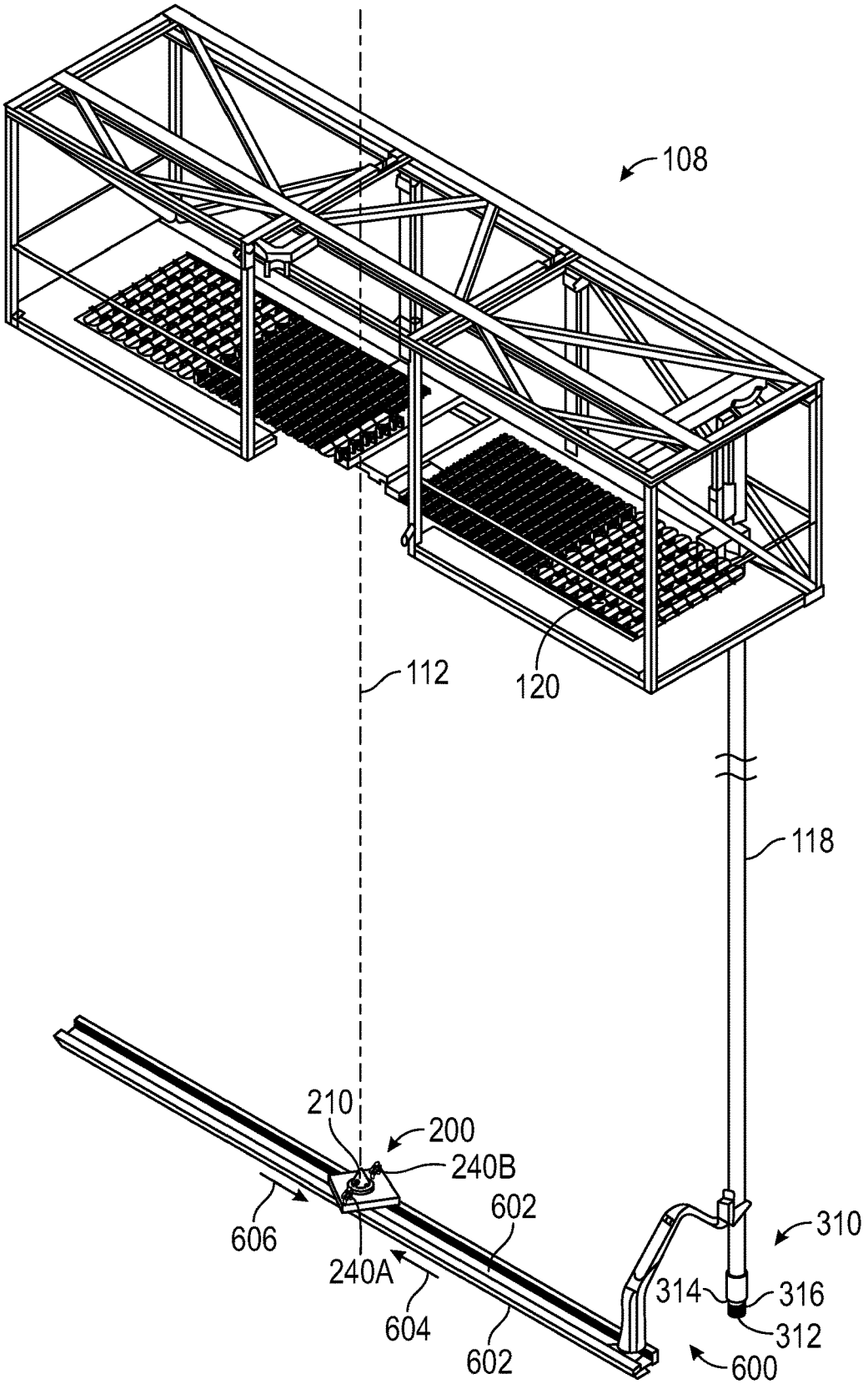
FIG. 6 illustrates a simplified perspective view of a stand storage assembly of the drilling rig system, showing a stand in a racked position, according to an embodiment.

Referring again to the method 400 of FIG. 4, the tubular handling equipment may then lift the stand 118 out of the mousehole 116 and position the stand 118 in a vertical orientation in the fingerboard 120, as at 404. FIG. 6 illustrates the stand 118 positioned in the vertical orientation in the fingerboard 120. This position may be referred to as the "racked" position of the stand 118. In various embodiments, there may be several or even dozens or hundreds of stands 118 present in the fingerboard 120 at any given time. Further, a lower racking mechanism 600 may guide a lower end 310 of the stand 118 as it is moved in the fingerboard 120 by tubular handling equipment located at the top of the stand 118. The lower racking mechanism 600 may be located at the setback platform 122 level, or near thereto. When the stand 118 is located at its intended racked position, the lower racking mechanism 600 may release the stand 118 and assist in moving other stands. In some embodiments, a second lower racking mechanism (e.g., on an opposite side of the illustrated alleyway 602) may be employed to rack back stands 118 into the other side of the fingerboard 120.

The washing and doping mechanism 200 may be oriented at an angle (e.g., 45 degrees) with respect to a longitudinal axis through the setback platform 122 to allow the stand 118 to be introduced into the washing and doping mechanism 200 through two different sides of the washing and doping mechanism 200 (e.g., that are 180 degrees apart). For example, the stand 118 may be introduced into the washing and doping mechanism 200 in a first direction 604 and/or in a second direction 606. In another embodiment, the sprayers 240A, 240B may be rotated around the central longitudinal axis 212 through the washing and doping mechanism 200 to allow the stand 118 to be introduced through two different sides of the washing and doping mechanism 200.

Figure 7:
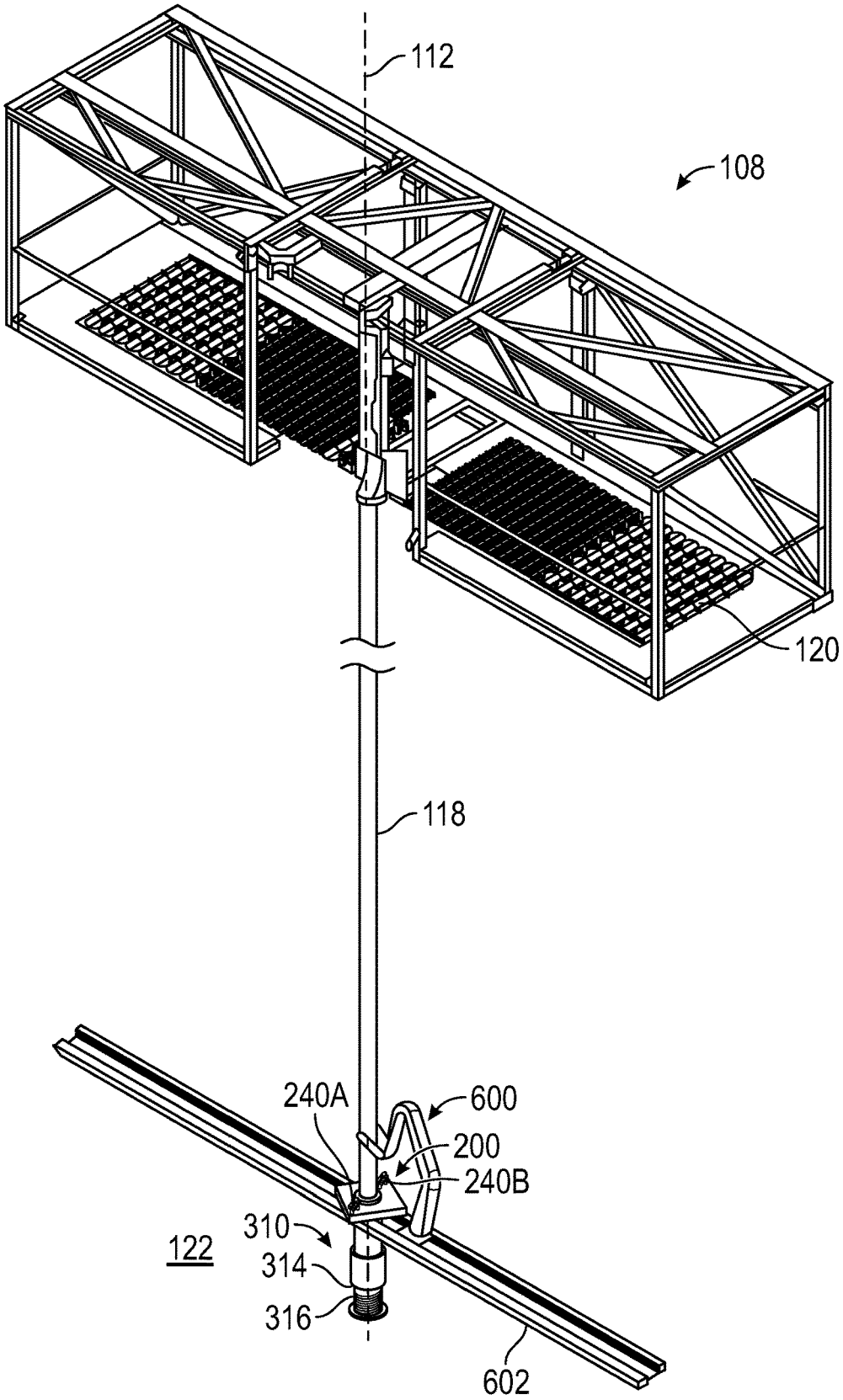
FIG. 7 illustrates a simplified perspective view of the stand storage assembly, showing the stand in a washing and doping position (also referred to as a stand handoff position), according to an embodiment.

Referring again to FIG. 4, the method 400 may also include moving the stand 118 from the racked position to a washing and doping position (also referred to as the stand handoff position), as at 406. Moving the stand 118 into the washing and doping position may include aligning the stand 118 with the central longitudinal axis 212 through the washing and doping mechanism 200, and then lowering the stand 118 until the lower end 310 of the stand 118 rests upon the bushing 210. The lowering of the stand 118 onto the washing and doping position is shown in FIG. 7, and may be at least partially supported by the lower lacking mechanism 600.

Referring again to FIG. 4, the method 400 may also include rotating the stand 118 and the bushing 210, as at 408. More particularly, the washing and doping mechanism 200 may rotate the bushing 210, and the engagement of the stand 118 with the bushing 210 may cause the stand 118 to rotate in a vertical orientation together therewith, as discussed above with respect to FIG. 2. For example, the central longitudinal axis 212 of the bushing 210 may be substantially parallel and/or aligned with a central longitudinal axis of the stand 118.

The method 400 may also include washing and/or applying dope to the lower end 310 of the stand 118, as at 410. In at least one embodiment, the lower end 310 of the stand 118 may be washed and doped while the stand 118 is in the vertical orientation and/or rotating. More particularly, the sprayers 240A, 240B may spray radially inward with respect to the central longitudinal axis 212 to wash and dope the lower end 310 of the stand 118. This may provide a more controlled and/or uniform application of the water, solvent, gas, pipe dope, or a combination thereof than conventional nozzles.

In one example, one or more of the nozzles 244A, 244B may first spray the first shoulder 312, the second shoulder 314, and/or the threads 316 sequentially or simultaneously with water and/or solvent to clean the lower end 310 of the stand 118. One or more of the nozzles 244A, 244B may then spray the first shoulder 312, the second shoulder 314, and/or the threads 316 sequentially or simultaneously with gas (e.g., air) to dry the lower end 310 of the stand 118. One or more of the nozzles 244A, 244B may then spray the first shoulder 312, the second shoulder 314, and/or the threads 316 sequentially or simultaneously with pipe dope to lubricate the lower end 310 of the stand 118. In another example, the nozzle 244A may be configured to spray water, solvent, or both, and the nozzle 244B may be configured to spray gas, pipe dope, or both. In yet another example, both nozzles 244A, 244B may be configured to sequentially spray water and/or solvent, then spray air, and then spray pipe dope.

In at least one embodiment, the sprayers 240A, 240B may be moved vertically before spraying the lower end 310 of the stand 118, or simultaneously with spraying the lower end 310 of the stand 118. For example, the sprayers 240A, 240B may be lowered such that the nozzles 244A, 244B are positioned below the first shoulder 312, and the nozzles 244A, 244B may be tilted upwards at an angle from about 5 degrees to about 45 degrees with respect to horizontal to facilitate spraying the substantially horizontal surfaces of the first shoulder 312 and/or the second shoulder 314 and the threads 316 simultaneously. The above-mentioned gap 320 between the outer diameter of the first shoulder 312 and the bushing 210 (or the drive gear bushing 220) may allow the nozzles 244A, 244B to spray at least a portion (e.g., a majority) of the substantially horizontal surface of the first shoulder 312. This is in contrast to conventional mechanisms where the substantially horizontal lower end of the tubular may be flush with a substantially horizontal (e.g., not conical) bushing or drive gear bushing, which would prevent the ability to spray the lower end of the tubular.

In one embodiment, the nozzles 244A, 244B may be configured to spray the first shoulder 312, the second shoulder 314, and the threads 316 simultaneously. In another embodiment, the nozzles 244A, 244B may not be able to spray the first shoulder 312, the second shoulder 314, and the threads 316 simultaneously, and the platforms 242A, 242B and/or the nozzles 244A, 244B may instead be moved up and/or down simultaneously with the nozzles 244A, 244B spraying and/or the stand 118 rotating.

Figure 8:
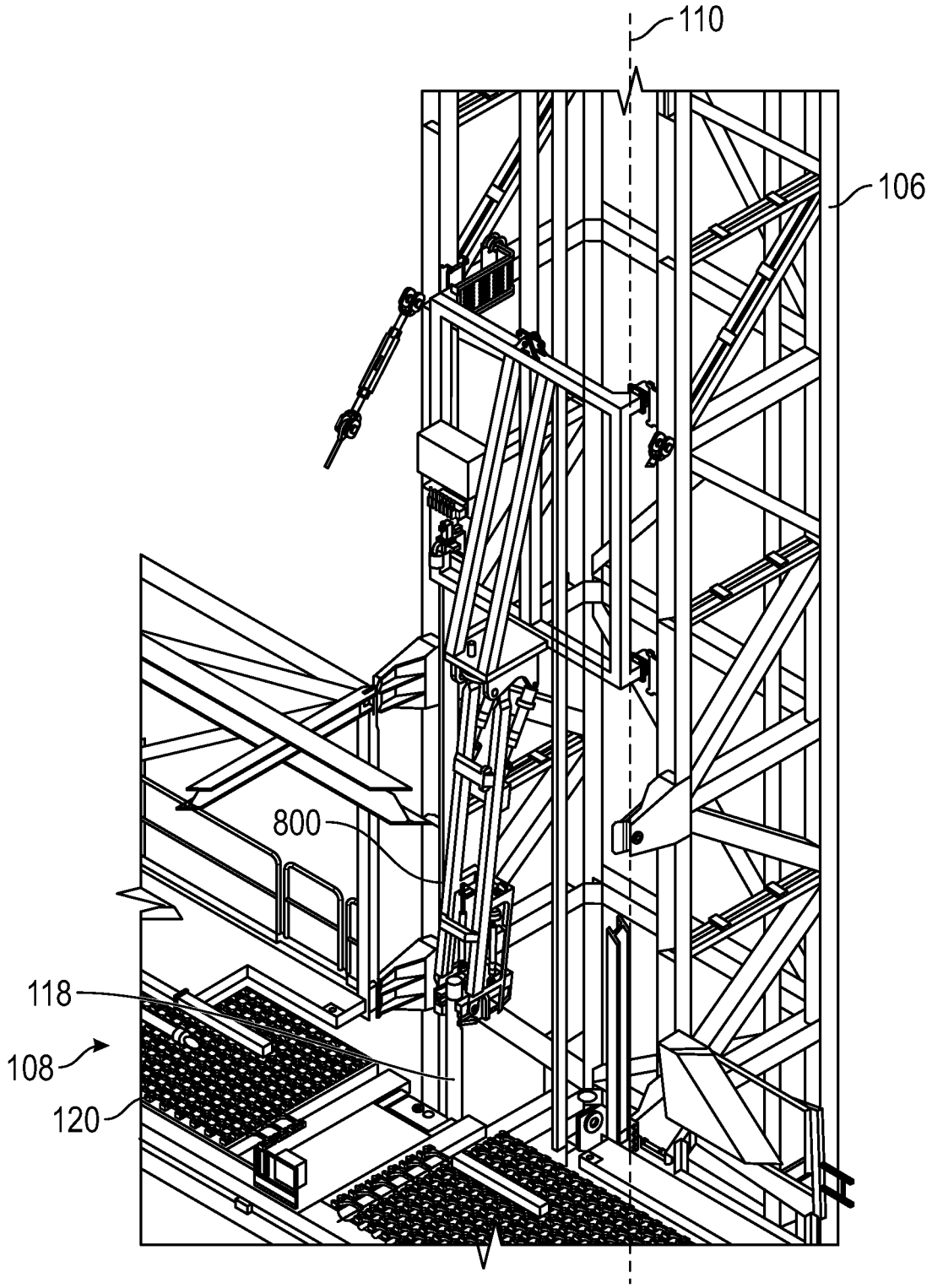
FIG. 8 illustrates a partial perspective view of the stand storage assembly and a mast of the drilling rig, according to an embodiment.

Referring again to the method 400 of FIG. 4, once the stand 118 has been washed and doped, the stand 118 may be moved from the washing and doping position to the well center 110, as at 412. For example, referring now to FIG. 8, when the top drive 130 (not shown) has ascended to an elevation in the mast 106 sufficient to accommodate the stand 118 above the well center 110, a tubular delivery arm 800 may grip the stand 118 at the washing and doping position. The tubular delivery arm 800 may raise the stand 118 vertically, such that the lower end 310 of the stand 118 clears the rig floor 104 (see, e.g., FIG. 1). At the same time, the tubular delivery arm 800 may swing laterally away from the fingerboard 120 and toward the mast 106. The tubular delivery arm 800 may then rotate, such that the stand 118 is delivered to the well center 110, below the top drive 130.

The method 400 may then proceed to conducting well-center operations using the stand 118 at the well center 110, as at 414. Such well center operations may include making the stand 118 up to the drill string. In such case, the washed and doped lower end 310 of the stand 118 may be threaded into and torqued to the drill string (e.g., using tongs). The top drive 130 may also be stabbed into the stand 118 over the well center 110, and employed to support and rotate the drill string via engagement with the stand 118. As such well center activities are occurring, the method 400 may loop back around, such that additional stands 118 are built, stored, washed/doped, and otherwise prepared for on-demand usage by the well center equipment.

Further, while the stand 118 is being washed and doped, well-center operations may be conducted at the well center 110 using another stand coupled to the top drive 130. For example, other stands (e.g., second or third stands), which were previously retrieved from the racked position, may be run into the wellbore as part of the drill string, contemporaneous to the washing and doping of the stand 118. Likewise, while the stand 118 is being employed for well-center operations, other stands may be constructed, stored, washed and doped, etc. As such, the drill rig system 100 executing the method 400 disclosed herein may operate these processes in parallel tracks, thereby increasing efficiency.

As used herein, the terms "inner" and "outer"; "up" and "down"; "upper" and "lower"; "upward" and "downward"; "upstream" and "downstream"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A washing and doping mechanism, comprising:

a bushing that is configured to engage a tubular that is in a substantially vertical orientation, wherein the bushing is configured to rotate, thereby causing the tubular to rotate about a central longitudinal axis of the tubular;

a motor;

a pinion gear configured to be rotated by the motor;

a drive gear configured to be rotated by the pinion gear, wherein the bushing is positioned above and configured to be rotated by the drive gear;

a load cell positioned at least partially below the drive gear, wherein the load cell is configured to measure a load that is to be used to determine whether the tubular is being at least partially supported by the bushing; and a sprayer configured to spray a fluid onto the tubular in the substantially vertical orientation.

2. The washing and doping mechanism of claim 1, wherein the bushing is at least partially conical.

3. The washing and doping mechanism of claim 2, wherein a width of the bushing increases proceeding downward.

4. The washing and doping mechanism of claim 1, wherein the bushing is configured to contact an inner diameter of a lower end of the tubular while a gap is present between the bushing and an outer diameter of the lower end of the tubular, and wherein the gap allows the fluid to contact at least a portion of a substantially horizontal surface of the lower end of the tubular.

5. The washing and doping mechanism of claim 1, further comprising a drive gear bushing positioned below the bushing, wherein the bushing is configured to contact an inner diameter of a lower end of the tubular while a gap is present between an outer diameter of the lower end of the tubular and the drive gear bushing, and wherein the gap allows the fluid to contact at least a portion of a substantially horizontal surface of the lower end of the tubular.

6. The washing and doping mechanism of claim 1, wherein the sprayer is configured to spray the fluid radially inward with respect to the central longitudinal axis while the tubular is rotating.

7. The washing and doping mechanism of claim 1, wherein at least a portion of the sprayer is tilted upward an angle with respect to horizontal to simultaneously spray a first shoulder of the tubular, a second shoulder of the tubular, and threads of the tubular that are positioned between the first and second shoulders, and wherein the angle is from about 1 degree to about 45 degrees.

8. The washing and doping mechanism of claim 1, wherein at least a portion of the sprayer is configured to move radially inward and outward with respect to the central longitudinal axis.

9. The washing and doping mechanism of claim 1, wherein at least a portion of the sprayer is configured to move vertically up and down with respect to the central longitudinal axis.

10. The washing and doping mechanism of claim 1, wherein the sprayer comprises at least two sprayers that are circumferentially offset from one another around the central longitudinal axis.

11. A rig, comprising:

a fingerboard configured to store a tubular in a substantially vertical orientation;

a racking mechanism configured to move the tubular from the fingerboard; and a washing and doping mechanism comprising:

a bushing that is configured to receive and at least partially support the tubular from the racking mechanism in the substantially vertical orientation, wherein the bushing is at least partially conical such that the bushing is configured to contact an inner diameter of a lower end of the tubular while a gap is present beneath an outer diameter of the lower end of the tubular, and wherein the bushing is configured to rotate, thereby causing the tubular to rotate while the tubular is in the substantially vertical orientation; and a sprayer positioned radially outward from a central longitudinal axis through the bushing, the tubular, or both, wherein the sprayer is configured to spray a fluid radially inward with respect to the central longitudinal axis, such that the fluid contacts threads of the tubular, a shoulder of the tubular, or both while the tubular is in the substantially vertical orientation and rotating, and wherein the fluid comprises water, solvent, gas, pipe dope, or a combination thereof, wherein at least a portion of the sprayer is configured to move vertically and radially with respect to the central longitudinal axis, and wherein the movement is performed manually or automatically by a computing system.

12. The rig of claim 11, wherein a nozzle of the sprayer is configured to be positioned at least partially below the lower end of the tubular and tilted upward such that the nozzle is configured to spray the fluid upward at an angle onto the lower end of the tubular, and wherein the angle is from about 1 degree to about 45 degrees with respect to horizontal.

13. The rig of claim 11, wherein the sprayer comprises:

a first sprayer that is configured to spray the water, the solvent, or both onto the tubular; and a second sprayer that is configured to spray the gas, the pipe dope, or both onto the tubular, wherein the first and second sprayers are circumferentially offset from one another around the central longitudinal axis.

14. The rig of claim 11, wherein the washing and doping mechanism further comprises:

a motor;

a pinion gear configured to be rotated by the motor;

a drive gear configured to be rotated by the pinion gear, wherein the bushing is positioned above and configured to be rotated by the drive gear; and a load cell positioned at least partially below the drive gear, wherein the load cell is configured to measure a load that is to be used to determine whether the tubular is being at least partially supported by the bushing.

15. A method for operating a rig, comprising:

positioning a tubular that is in a substantially vertical orientation onto a bushing such that the bushing contacts an inner diameter of a first shoulder of the tubular while a gap is present below an outer diameter of the first shoulder of the tubular;

rotating the bushing, wherein rotating the bushing causes the tubular to rotate therewith;

spraying the first shoulder of the tubular, a second shoulder of the tubular, and threads of the tubular with a fluid using a sprayer while the tubular is in the substantially vertical orientation;

wherein the step of spraying comprises:

lowering the sprayer until the sprayer is positioned beneath the first shoulder; and tilting the sprayer upward such that the fluid is sprayed at an angle with respect to horizontal, wherein the angle is from about 1 degree to about 45 degrees, and wherein the first shoulder, the second shoulder, and the threads are sprayed simultaneously.

16. The method of claim 15, wherein spraying the first shoulder, the second shoulder, and the threads with the fluid comprises:

spraying the first shoulder, the second shoulder, and the threads with water, a solvent, or both;

spraying the first shoulder, the second shoulder, and the threads with gas to at least partially dry the water, the solvent, or both; and spraying the first shoulder, the second shoulder, and the threads with pipe dope after the first shoulder, the second shoulder, and the threads are at least partially dried.

17. The method of claim 15, wherein spraying the first shoulder, the second shoulder, and the threads of the tubular with the fluid using the sprayer comprises:

spraying the first shoulder, the second shoulder, and the threads with water, a solvent, or both using a first sprayer; and spraying the first shoulder, the second shoulder, and the threads with gas, a pipe dope, or both using a second sprayer, wherein the first and second sprayers are circumferentially offset from one another with respect to a central longitudinal axis through the bushing, the tubular, or both.

18. The method of claim 15, further comprising:

connecting two joints together to form the tubular;

lifting the tubular out of a mousehole;

positioning the tubular in the substantially vertical orientation in a fingerboard after the tubular is lifted out of the mousehole;

moving the tubular from the fingerboard onto the bushing prior to the tubular being rotated and the sprayed with the fluid;

moving the tubular from the bushing into alignment with a well center after the tubular has been sprayed with the fluid; and conducting a well-center operation using the tubular when the tubular is aligned with the well center.

19. A rig, comprising:

a fingerboard configured to store a tubular in a substantially vertical orientation;

a racking mechanism configured to move the tubular from the fingerboard; and a washing and doping mechanism comprising:

a bushing that is configured to receive and at least partially support the tubular from the racking mechanism in the substantially vertical orientation, wherein the bushing is at least partially conical such that the bushing is configured to contact an inner diameter of a lower end of the tubular while a gap is present beneath an outer diameter of the lower end of the tubular, and wherein the bushing is configured to rotate, thereby causing the tubular to rotate while the tubular is in the substantially vertical orientation; and a motor;

a pinion gear configured to be rotated by the motor;

a drive gear configured to be rotated by the pinion gear, wherein the bushing is positioned above and configured to be rotated by the drive gear;

a load cell positioned at least partially below the drive gear, wherein the load cell is configured to measure a load that is to be used to determine whether the tubular is being at least partially supported by the bushing; and a sprayer positioned radially outward from a central longitudinal axis through the bushing, the tubular, or both, wherein the sprayer is configured to spray a fluid radially inward with respect to the central longitudinal axis, such that the fluid contacts threads of the tubular, a shoulder of the tubular, or both while the tubular is in the substantially vertical orientation and rotating, and wherein the fluid comprises water, solvent, gas, pipe dope, or a combination thereof.

* * * * *